US005323141A

United States Patent [19]

Petek

[11] Patent Number: 5,323,141

[45] Date of Patent: Jun. 21, 1994

[54] GLASS BREAK SENSOR HAVING REDUCED FALSE ALARM PROBABILITY FOR USE WITH INTRUSION ALARMS

[75] Inventor: Tom R. Petek, Sacramento, Calif.

[73] Assignee: C & K Systems, Inc., Folsom, Calif.

[21] Appl. No.: 962,527

[22] Filed: Oct. 16, 1992

[51] Int. Cl.[5] ..... G08B 13/22

[52] U.S. Cl. ..... 340/566; 340/541; 340/544; 340/550

[58] Field of Search ..... 340/566, 550, 544, 541

[56] References Cited

U.S. PATENT DOCUMENTS 5,185,593 2/1993 DuRand, III et al. ..... 340/566

OTHER PUBLICATIONS

Instruction manual of BGE-9809, manufactured by Blue Grass Electronics, Inc., and photograph of device BGE-9809 as described in the manual.

F. Fraim & P. Murphy, "Miniature Electret Microphones," *Journal of the Audio Engineering Society,* Presented May 5, 1970, from An Anthology of Articles on Microphones, vols. 1-27 (1953-1979), pp. 276-282.

R. B. Schulein, "Development of a Versatile Professional Unidirectional Microphone," *Journal of the Audio Engineering Society,* Presented Apr. 28, 1969, from an Anthology of Articles on Microphones, vols. 1-27 (1953-1979), pp. 195-201.

B. B. Bauer, "Equivalent Circuit Analysis of Mechano-Acoustic Structures," *Journal of the Audio Engineering Society,* from An Anthology of Articles on Microphones, vols. 1-27 (1953-1979), pp. 162-171.

H. T. Souther, "An Adventure in Microphone Design," *Journal of the Audio Engineering Society,* from An Anthology of Articles on Microphones, vols. 1-27 (1953-1979), pp. 73-78.

*Acoustics,* Leo L. Beranek, Chapter 5, subchapters 5.6 through 5.9, published for the Acoustical Society of America by the American Institute of Physics, 1954 & 1986 Edition, pp. 131-138.

*Primary Examiner*—Glen R. Swann, III

*Attorney, Agent, or Firm*—Limbach & Limbach

[57] ABSTRACT

A sensor has a reduced probability of generating a false alarm in the presence of a strong high frequency acoustic wave, such a false alarm being caused by the saturation of the microphone which is part of a single microphone glass break sensor. The sensor improves an alarm system's immunity to false alarms by using two microphones instead of one, wherein each microphone is used in combination with a filter and a signal processing stage to detect one of the characteristic components of an acoustic wave generated in a glass break event. The microphone used to detect the low frequency component is fitted with an acoustic filter which attenuates the high frequency component of the wave. This reduces the probability of a false alarm by ensuring that the low frequency electrical signals fed to the alarm system's logic and timing circuit are generated by an external event rather than by the microphone itself.

9 Claims, 4 Drawing Sheets

GLASS BREAK SENSOR HAVING REDUCED FALSE ALARM PROBABILITY FOR USE WITH INTRUSION ALARMS

TECHNICAL FIELD

The present invention is generally directed to an intrusion alarm system which detects an intrusion into a protected structure by sensing the breaking of glass, and more specifically, to a glass break sensor having a reduced probability of generating a false alarm.

BACKGROUND OF THE INVENTION

Intrusion alarms are devices which generate an alarm signal when an unauthorized entry into a protected structure is detected. One common method for gaining access into a protected structure is to break the glass in a window. In response to this mode of entry, glass break detectors have been developed which generate an alarm signal when the sound of breaking glass is detected.

When glass mounted in the wall of a room is broken by impact, the acoustic signal produced is a function of several variables. These variables include the type of glass, its size, the mounting method, and the acoustic properties of the room. When glass breakage due to a forced entry occurs, the acoustic signal which is generated contains both low frequency and high frequency components. The frequency spectrum of the signal is very wide, ranging from below 3 Hz to well over 20 kHz.

The low-frequency components of the signal are caused by the initial displacement of the glass as it rebounds from the blow which is intended to break the glass. If the mounting frame and wall are flexible, they may contribute to the low-frequency components as well. The high-frequency components of the acoustic signal are generated by the initial impact, the actual fracturing of the glass, and by collisions of glass fragments with each other and with barriers in the room.

Glass break detectors which rely on detecting the acoustic signal generated by breaking glass operate by selectively detecting one or more of the frequency components associated with the event. Some glass break detectors are sensitive to only a narrow band of frequencies in the high end of the spectrum, while others detect high and low frequency components of the signal. Glass break detectors such as model FG-730 manufactured by C & K Systems, Inc. of Folsom, Calif., require two frequency components to have a defined duration and arrive nearly simultaneously before the acoustic signal is identified as a glass break. Sensing multiple rather than single frequency components of a glass-break event reduces the system's probability of generating a false alarm.

However, it has been discovered that intrusion alarms which depend upon the sensing of both low and high frequencies are susceptible to false alarms in the presence of a large high frequency acoustic signal. The electret microphone used in many glass break sensors to detect both the low and high frequency components of the signal is believed to be the source of the problem. This type of microphone is used because at this time it is the only commercially available one which can effectively cover the desired frequency range of 3 Hz to 20 kHz. In most systems, the combined acoustic signal is detected by the microphone and then subjected to filtering in order to separate out the various components. After filtering, the signals are processed, with the output of the signal processing circuits being sent to a logic and timing circuit to determine if an intrusion alarm signal is warranted.

In such single microphone systems it has been found that the microphone's field-effect-transistor (FET) saturates in the presence of a large high frequency acoustic signal. Such a signal causes the FET to operate in a non-linear fashion and to produce low frequency electrical signals in addition to the high frequency electrical signals it produces as a result of detecting the high frequency acoustic signal (note that other types of microphones also have dynamic range limitations, even if only due to mechanical limitations on the motion of their components). This means that the microphone's output will consist of electrical signals which would normally indicate the detection of both low and high frequency acoustic signals, and these electrical signals will then be sent to the filtering and signal processing stages of the alarm system. The result is that an intrusion alarm signal can be generated in the presence of only a high frequency acoustic signal, in which case the alarm signal is a false alarm.

What is desired is a means of reducing the probability of a false alarm being generated in response to the saturation of the sensor in an intrusion alarm system which uses a single microphone to detect various acoustic components of a glass break event.

SUMMARY OF THE INVENTION

The present invention is directed to a glass break sensor for use in an intrusion alarm system. The sensor is less susceptible to generating a false alarm in the presence of a strong high frequency acoustic signal, where such a false alarm is caused by the saturation of the FET in an electret microphone, or by similar dynamic range limitations in other type of microphones which are a part of the sensor.

The present invention improves an alarm system's immunity to false alarms by using two microphones instead of one, where one microphone is used in combination with a filter and a signal processing stage to detect only low frequency components of the acoustic signal generated in a glass break event. The microphone used to detect the low frequency components is fitted with a passive acoustic filter which attenuates the high frequency component of the signal. This reduces the probability of a false alarm by ensuring that the low frequency electrical signals fed to the alarm system's logic and timing circuit are generated by an external event rather than by the microphone itself. The other microphone is used to detect all other characteristics of the signal.

Further acoustic and/or electronic subdivision of the signal is also possible. More extensive use of acoustic filtering is appealing because it reduces the need for additional electronic circuitry. However, the present application discusses only the simplest embodiments of the present invention.

DETAILED DESCRIPTION OF THE PREFERRED EMBODIMENT

Figure 1:
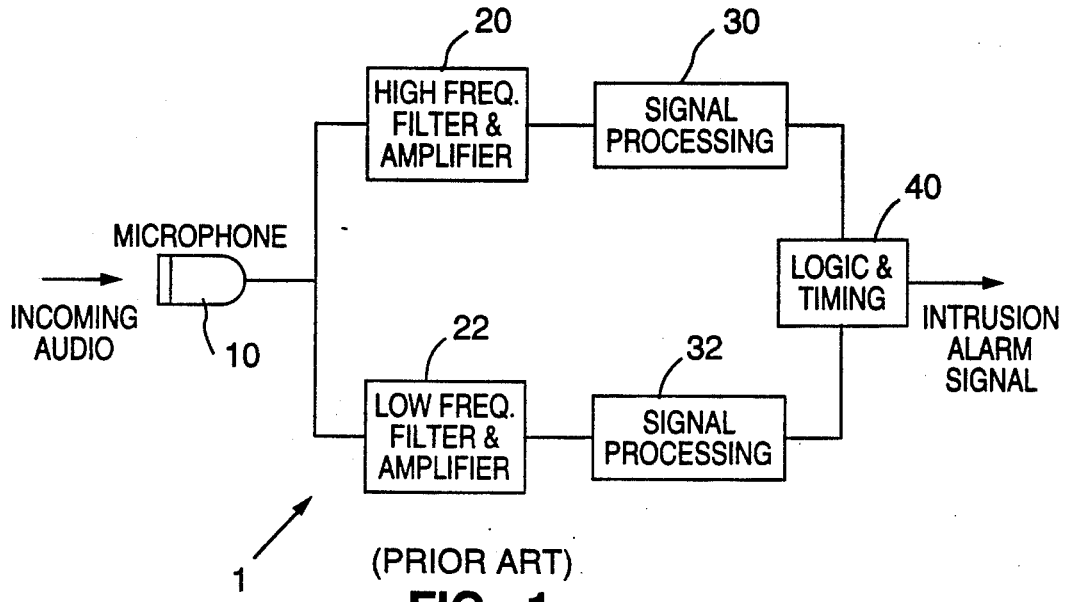
(PRIOR ART) FIG. 1
FIG. 1 is a block diagram of a glass break sensor of the prior art which utilizes a single microphone to detect both low and high frequency components of the glass break event.

Referring to the figures, and in particular to FIG. 1, there is shown a block diagram of a glass break sensor 1 of the prior art for use in an intrusion alarm system. Sensor 1 utilizes a single microphone 10 to detect both the low and high frequency components of the acoustic signal generated by a glass break event. Microphone 10 may be the electret type used in many alarm systems, or it may be any type suited to the desired application. Microphone 10 detects the acoustic signal produced by a glass break event, and responds to the signal by producing electrical signals.

The electrical signals produced by microphone 10 are sent to a high frequency channel composed of a high frequency filter and amplification stage 20 and an associated signal processing circuit 30, and to a low frequency channel composed of a low frequency filter and amplification stage 22 and an associated signal processing circuit 32. The amplification stage is used because otherwise the signal levels would be insufficient. The purpose of signal processing circuits 30 and 32 is to isolate and qualify the desired signals from any accompanying noise which is present on the channel. The outputs of signal processing circuits 30 and 32 are sent to a logic and timing circuit 40 which determines if the signal components satisfy the conditions required to initiate an intrusion alarm signal.

As mentioned, it has been discovered that intrusion alarm systems having glass break sensors which use a single microphone to sense both the low and high frequencies produced in a glass break event are susceptible to false alarms in the presence of a large high frequency acoustic signal. The electret microphone used in many glass break sensors has been found to be the source of a false alarm signal because the microphone's field-effect-transistor (FET) saturates in the presence of a large high frequency acoustic signal. This is a problem because there are a number of sources of high energy acoustic signals other than glass break events, for example, the shrieking of a baby or the slamming of a metal door. In an electret microphone, such a signal causes the FET to become non-linear in its operation and to produce low frequency electrical signals which accompany the high frequency electrical signals it produces as a result of detecting a high frequency acoustic signal. This means that the output of the microphone contains both low and high frequency electrical signals, with the result that an intrusion alarm signal can be generated in the presence of only a high frequency acoustic signal.

Figure 2:
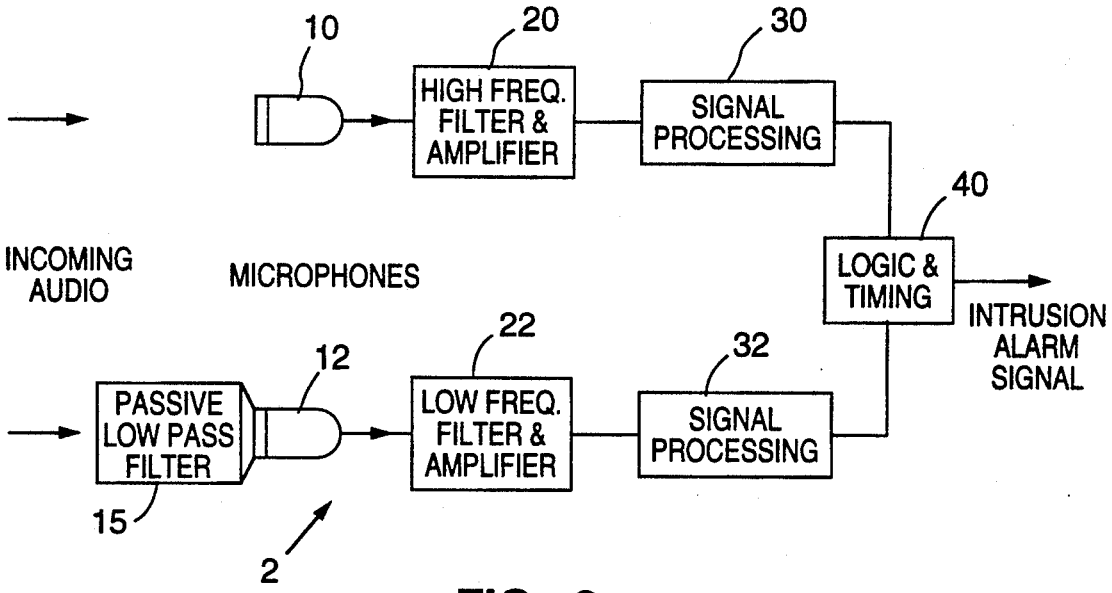
FIG. 2 is a block diagram of a glass break sensor constructed according to the present invention which uses two separate microphones, one of which has a passive acoustic filter, to detect low and high frequency components of the glass break event.

In order to prevent the generation of a false alarm signal in the presence of a large high frequency acoustic signal, an improved glass break sensor is constructed as shown in FIG. 2, which shows a block diagram of a glass break sensor 2 constructed according to the present invention. Sensor 2 uses two separate microphones 10 and 12 to detect the low and high frequency components of the acoustic signal generated in a glass break event. A first microphone 10 detects the acoustic signal corresponding to a glass break event and responds to that signal by producing electrical signals. The electrical signals are sent to a high frequency channel composed of a high frequency filter and amplification stage 20 and an associated signal processing circuit 30.

A second microphone 12 has a passive low pass filter 15 affixed. Filter 15 acts to filter out the high frequency component of the acoustic signal, thereby significantly reducing its intensity at microphone 12. Microphone 12 and filter 15 detect the acoustic signal corresponding to a glass break event and respond to that signal by producing electrical signals. The electrical signals are sent to a low frequency channel composed of a low frequency filter and amplification stage 22 and an associated signal processing circuit 32. The outputs of signal processing circuits 30 and 32 are sent to a logic and timing circuit 40 which determines if the signal components satisfy the conditions required to initiate an intrusion alarm signal.

The benefit of glass break sensor 2 of the present invention is that the low and high frequency components of the acoustic signal are detected by separate, acoustically pre-conditioned microphones. This isolates the acoustic signal paths which correspond to the two frequency components. This significantly reduces the possibility of a false alarm because the presence of a large high frequency acoustic signal is unlikely, by itself, to initiate an intrusion alarm signal.

A reduced probability of generating a false alarm results because any low frequency electrical signal produced as a result of the saturation of the high frequency channel microphone 10 will be filtered out by high frequency filter 20. Similarly, because the high frequency component of the acoustic signal is filtered out by passive low frequency filter 15 before it reaches low frequency channel microphone 12, any low frequency electrical signal which reaches low frequency filter 22 is caused by the detection of an external acoustic signal, and not because of the saturation of the microphone.

Figure 3:
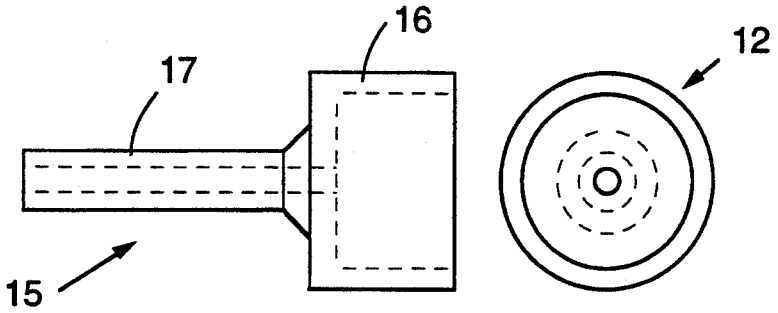
FIG. 3 shows a first embodiment of the passive acoustic filter of FIG. 2.

FIG. 3 shows a first embodiment of passive acoustic filter 15 of the present invention. Filter 15 is designed to fit over the top of low frequency channel microphone 12, the bottom view of which is also shown in FIG. 3. Filter 15 is composed of an interface 16 which fits snugly over the top of microphone 12, and a neck 17 which extends from interface 16. The cross-sectional area of neck 17 is smaller than that of interface 16.

Figure 4:
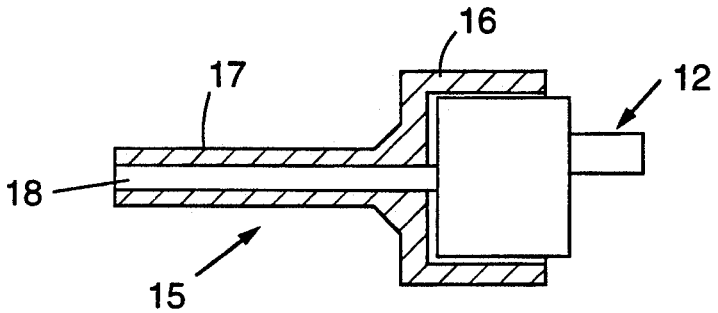
FIG. 4 shows a cross-sectional view of the passive acoustic filter of FIG. 3 after installation on a microphone.

FIG. 4 shows a cross-sectional view of passive acoustic filter 15 of FIG. 3 after installation on low frequency channel microphone 12. As in FIG. 3, filter 15 is composed of an interface 16 and a neck 17. The cross-sectional view shows that neck 17 is hollow, as indicated by the presence of orifice or air channel 18. When an acoustic signal enters air channel 18, the high frequency components of the signal are attenuated, so that the acoustic signal reaching microphone 12 is primarily composed of low frequencies.

Figure 5:
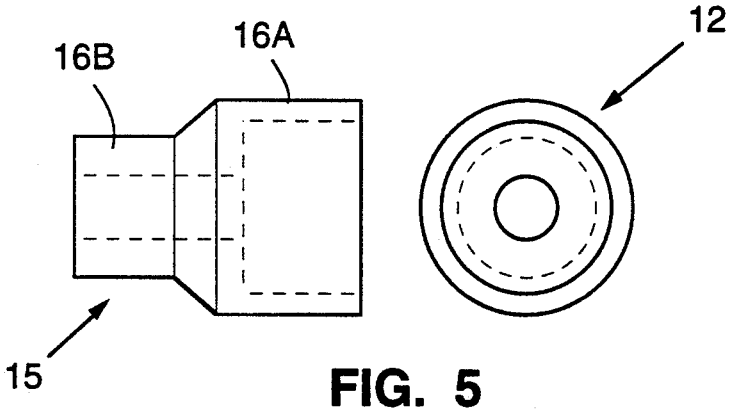
FIG. 5 shows a second embodiment of the passive acoustic filter of FIG. 2.

FIG. 5 shows a second embodiment of passive acoustic filter 15 of the present invention. Filter 15 is designed to fit over the top of low frequency channel microphone 12, the bottom view of which is also shown in FIG. 5. In this embodiment filter 15 is composed of an interface 16A Which fits snugly over the top of microphone 12. Interface 16A is fabricated so as to have a short, hollow extension, denoted by 16B.

Figure 6:
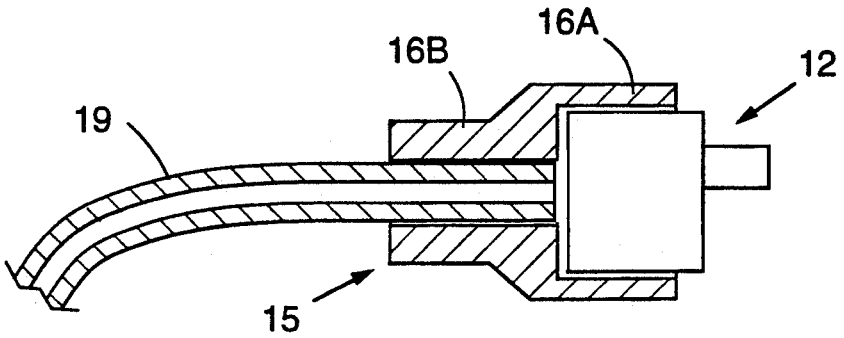
FIG. 6 shows a cross-sectional view of the passive acoustic filter of FIG. 5 after installation on a microphone, and includes a tube which extends the orifice, of the filter.

FIG. 6 shows a cross-sectional view of passive acoustic filter 15 of FIG. 5 after installation on low frequency channel microphone 12. Also shown is a hollow tube 19 having a small cross-sectional area, which fits snugly into hollow extension 16B of interface 16A. Hollow tube 19 and interface 16A may be preferable to the use of interface 16 shown in FIGS. 3 and 4 in situations where neck 17 of interface 16 is difficult to mold, or is not suited for the intended use.

Figure 7:
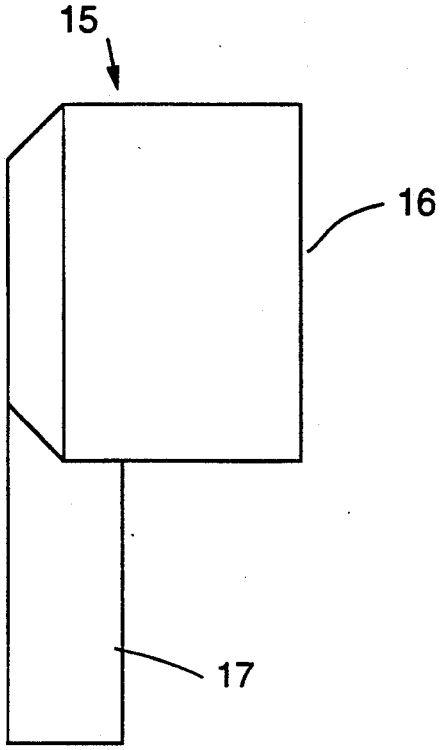
FIG. 7 shows a third embodiment of the passive acoustic filter of FIG. 2.

FIG. 7 shows a third embodiment of passive acoustic filter 15 of the present invention. Here filter 15 is again composed of an interface 16 which fits snugly over the low frequency channel microphone (not shown). However, in this embodiment neck 17 extends perpendicular to the microphone axis (downward from interface 16 as depicted in FIG. 7) instead of axially as in FIG. 3. This design is preferable for situations in which space constraints prevent the use of the axial neck embodiment.

Figure 8:
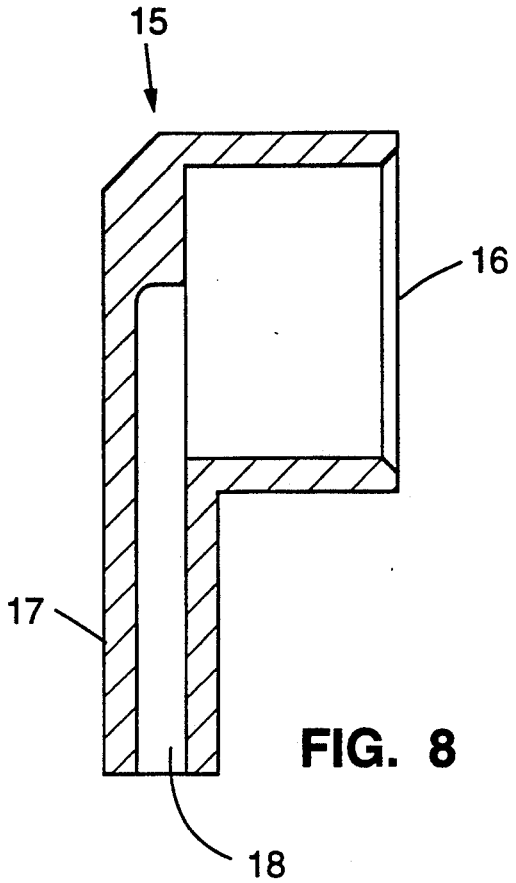
FIG. 8 shows a cross-sectional view of the passive acoustic filter of FIG. 7.

FIG. 8 shows a cross-sectional view of the passive acoustic filter 15 of FIG. 7. This view clearly indicates that neck 17 is hollow, as indicated by the presence of orifice or air channel 18. When an acoustic signal enters air channel 18, the high frequency components of the signal are attenuated, so that the acoustic signal reaching the low frequency channel microphone is primarily composed of low frequencies.

The dimensions of and materials used by the inventor to construct the passive acoustic filter of the present invention will now be described. For the embodiments of either FIGS. 3, 5, or 7, it has been found that molded rubber is a preferred material. Molded rubber provides the desired snug fit between interface 16 or 16A and the microphone case, thus eliminating the need for adhesives. When made of rubber, orifice section 17 of FIGS. 3 or 7 is flexible and can be bent or arranged as needed for its intended use.

In situations where the embodiment of FIG. 5 is used, extension 16B of interface 16A is also made of rubber, however tube 19 Can be made of plastic or rubber tubing. Tube 19 serves the same purpose as neck 17 of interface 16 and the particular material chosen depends on the degree of flexibility desired for the intended application.

With regards to the dimensions of the passive acoustic filter, it has been found that a significant attenuation of the high frequency components of the audio signal can be achieved when neck 17 has a length of approximately one-half inch and orifice 18 has a diameter of approximately one-sixteenth of an inch. The amount of attenuation, and the frequency range over which it occurs is a function of the dimensions of neck 17 and orifice 18 or tube 19 used in the device.

With the dimensions given, an average reduction of 10 dB in the electrical signal generated by a microphone fitted with the passive acoustic filter of the present invention has been noted for frequencies beyond about 3 KHz, when compared to an identical microphone without the filter. The reduced response of the microphone is a result of the reduction in intensity of the acoustic signal beyond a frequency of 3 KHz, and occurs due to the attenuation provided by the filter. The reduction in the electrical signal decreases the probability of a false alarm being generated from the response of the microphone to a large high frequency acoustic signal.

Passive acoustic filter 15 acts like the acoustical equivalent of an electrical inductor. The acoustical inertia of the air in orifice 18 or tube 19 of filter 15 is sufficiently large to prevent it from being driven by high frequency acoustic signals, causing them to be damped out. This means that such signals are not transmitted down orifice 18 to microphone 12 where they would normally be detected. In addition, passive filter 15 has a resistive component which causes additional losses to the signal. This behavior results from frictional surface effects (turbulence) at the walls of the orifice. The effect is similar to a viscous force and further reduces the amplitudes of the high frequency components of the acoustic signal. The combined resistive and inductive behavior of filter 15 cause the high frequency components of the acoustic signal to be attenuated, leaving primarily the low frequency components of the external acoustic signal to be detected at the low frequency channel microphone, and then processed by the low frequency channel of the sensor.

In this sense the passive acoustic filter of the present invention is similar to a standard RL filter encountered in the field of electronics. The impedance of such a filter has a resistive and inductive component, and the impact of such a filter on the frequency spectrum of an input signal depends on the characteristics of the filter and the frequency in question. The electronic RL filter has acoustic analogues whose behavior is described in the literature. A standard source for such information is the text "Acoustics" by Leo L. Beranek, published by the American Institute of Physics (1986).

Figure 9:
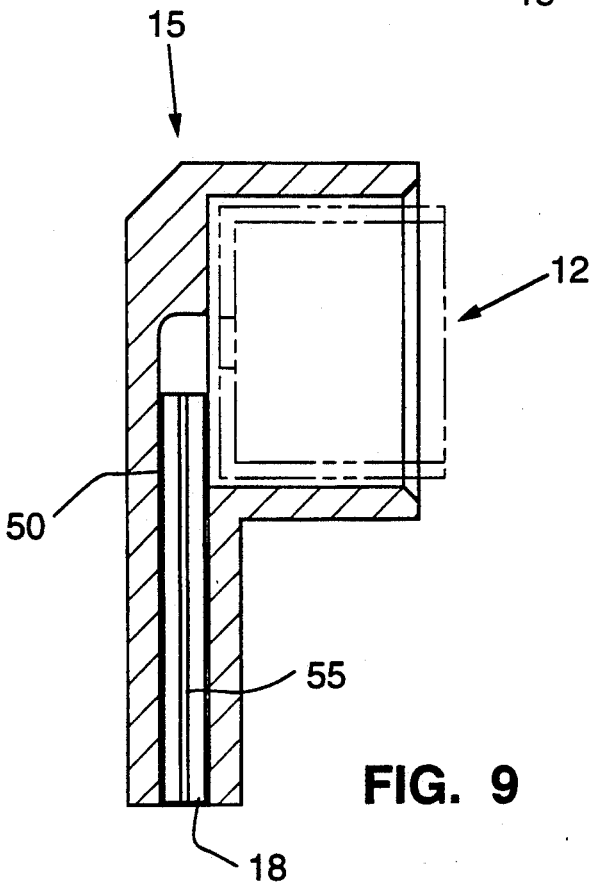
FIG. 9 shows a cross-sectional view of the passive acoustic filter of FIG. 7, with the addition of a restrictive element which may be used to enhance its filtering ability.

It is possible to further improve the filtering ability of the passive acoustic filter of the present invention by means of a restrictive element which is inserted into the orifice contained in the neck of the filter. This is useful when the orifice dimensions which can be easily fabricated do not provide the desired degree of attenuation of the high frequency acoustic signal. FIG. 9 is a cross-sectional view of passive acoustic filter 15 of FIG. 7, and shows a restrictive element 50 inserted into orifice 18 which may be used to enhance the filtering ability of filter 15.

Restrictive element 50 should be constructed so as to contain an acoustic pathway 55 to allow acoustic signals to propagate through it to the microphone. The inventor has found that a solid restrictive element having a square slot of dimension 1/80th of an inch on a side milled along its entire length provides an excellent degree of filtering when snugly inserted into orifice 18. Examples of materials from which to construct restrictive element 50 are plastic, teflon tubing, or molded rubber pieces. Because the restrictive element diminishes the cross-sectional area of the orifice, it alters the inductance and resistance of the orifice. This affects both the frequency beyond which significant attenuation occurs (the cut-off frequency) as well as the amount of attenuation which occurs as a function of frequency.

Figure 10:
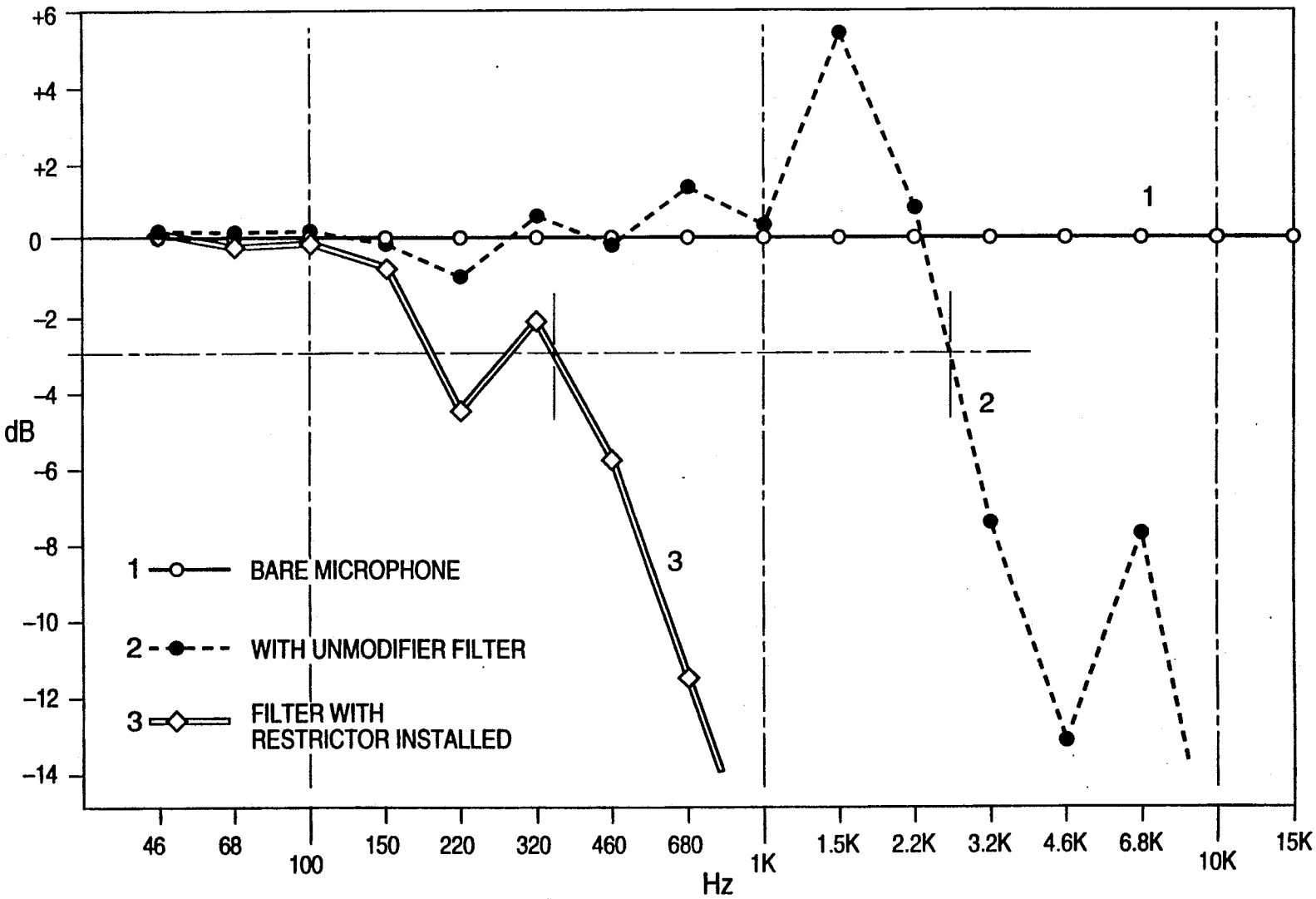
FIG. 10 is a series of graphs showing the output response as a function of input frequency for a bare test microphone, the same microphone with the passive acoustic filter of the present invention, and the same microphone with the passive acoustic filter and restrictive element of the present invention, all normalized to the response of the bare microphone.

The filtering capability of the passive acoustic filter of the present invention is apparent from FIG. 10, which is a series of graphs showing the output response as a function of input frequency for a bare test microphone, the same microphone on which is installed the passive acoustic filter of the present invention, and the same microphone on which is installed the passive acoustic filter and restrictive element of the present invention. The data used to generate the graphs was normalized to the response of the bare microphone.

The data labeled (1) corresponds to the response of an electret microphone of the type used in intrusion alarm systems which was tested without the use of the passive acoustic filter of the present invention. The graph is a straight line because the other data was normalized to the data used to produce this graph. The graph labeled (2) corresponds to the response for the same microphone when a passive filter of the type shown in FIG. 7 was used. The filter was made of rubber and had a neck length of 14.70 millimeters (mm) and an orifice diameter of 1.59 mm. The data labeled (3) corresponds to the response for the same microphone and filter as in (2), with the addition of a restrictive element which was inserted into the orifice. The restrictive element was solid and made of plastic, and had a square slot of dimension 0.3 mm milled along it.

Comparison of the graphs in FIG. 10 clearly indicates that significant attenuation of signals having a frequency beyond approximately 2 kHz can be obtained by using the filter of the present invention. The use of a restrictive element is observed to provide greater attenuation at lower frequencies, i.e., the cut-off frequency is reduced compared to that which is found when using only the filter. The dips in graphs (2) and (3) at around 220 Hz is an artifact of the acoustic test chamber in which the tests were performed. The spike in graph (2) at around 2 kHz is a result of an unwanted resonance due to details of the geometry of the filter.

The present invention thus provides a means to reduce false alarms through low (or no) power acoustic filtering. The addition of a second microphone and passive acoustic filter requires no additional signal processing and isolates the high and low frequency components of the glass break signal. This is an advantage in devices which have a self-contained power source, such as battery powered alarm systems. In addition, the dimensions of the passive filter can be modified to alter the amount of attenuation and the frequency beyond which significant attenuation occurs.

For example, if the length of the orifice is increased, the cut-off frequency is expected to decrease. This means that the frequency which corresponds to the upper limit of the range of frequencies not subject to significant attenuation can be lowered by lengthening the orifice. This is accomplished by increasing neck 17 or tube 19 in the respective embodiments of the present invention. Thus if the glass break sensor used in an alarm system functions by detecting low frequency acoustic signals below a certain frequency, the passive acoustic filter of the present invention can be constructed to attenuate signals having a higher frequency. This will provide the optimal reduction in false alarm probability and further improve the performance of the system.

While the present invention has been described with reference to the specific embodiment and elements disclosed, it is understood that other, equivalent embodiments of the invention are possible, and that the practice of the invention is not intended to be limited solely to the embodiments specifically disclosed in this application.

I claim:

1. A glass break sensor for use in an intrusion alarm system which detects an intrusion by sensing an acoustic wave produced by a glass break event, said acoustic wave having a low frequency component, the sensor comprising:

first detecting means for detecting said acoustic wave and for generating a first electrical signal in response thereto;

first processing means for receiving said first electrical signal and for processing said first electrical signal to produce a processed first electrical signal;

second detecting means for detecting only said low frequency component of said acoustic wave and for generating a second electrical signal in response thereto;

second processing means for receiving said second electrical signal and for processing said second electrical signal to produce a processed second electrical signal; and logic means for receiving said processed first and second electrical signals and for generating an alarm signal in response thereto.

2. A glass break sensor for use in an intrusion alarm system which detects an intrusion by sensing an acoustic wave produced by a glass break event, said acoustic wave having a low frequency component, the sensor comprising:

first detecting means for detecting said acoustic wave and for generating a first electrical signal in response thereto;

first processing means for receiving said first electrical signal and for processing said first electrical signal to produce a processed first electrical signal;

second detecting means for detecting only said low frequency component of said acoustic wave and for generating a second electrical signal in response thereto, wherein said second detecting means further comprises:

low pass acoustic filter means for receiving said acoustic wave and for passing said low frequency component of said acoustic wave therethrough; and microphone means attached to said acoustic filter means for receiving said low frequency component of said acoustic wave and for generating said second electrical signal in response thereto;

second processing means for receiving said second electrical signal and for processing said second electrical signal to produce a processed second electrical signal; and logic means for receiving said processed first and second electrical signals and for generating an alarm signal in response thereto.

3. The sensor of claim 2, wherein said low pass acoustic filter means further comprises;

an interface portion, wherein said interface portion fits snugly over said microphone means; and a hollow neck portion which extends from said interface, thereby forming a low pass acoustic filter which significantly reduces the intensity of high frequency acoustic waves which enter said neck portion.

4. The sensor of claim 3, wherein said interface portion and neck portion of said low pass acoustic filter are fabricated from molded rubber.

5. The sensor of claim 3, further comprising:

a restrictive element containing an acoustic signal pathway inserted into said hollow neck portion of said low pass acoustic filter, wherein said restrictive element further reduces the intensity of high frequency acoustic waves which enter said neck portion.

6. The sensor of claim 2, wherein said low pass acoustic filter further comprises:

an interface portion, wherein said interface portion fits snugly over said microphone means;

a hollow neck portion which extends from said interface; and a hollow tube portion which fits into said neck portion and extends therefrom, thereby forming a low pass acoustic filter which significantly reduces the intensity of high frequency acoustic waves which enter said tube portion.

7. The sensor of claim 6, wherein said interface portion and neck portion of said low pass filter acoustic are fabricated from molded rubber.

8. The sensor of claim 7, wherein said tube portion of said low pass acoustic filter is fabricated from molded rubber.

9. The sensor of claim 7, wherein said tube portion of said passive low pass filter is fabricated from plastic.

* * * * *